US008983340B2

(12) United States Patent
Shin et al.

(10) Patent No.: US 8,983,340 B2
(45) Date of Patent: Mar. 17, 2015

(54) IMAGE FORMING APPARATUS

(75) Inventors: Jae-hyun Shin, Seoul (KR); Young-su Lee, Suwon-si (KR); Joon-hee Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 856 days.

(21) Appl. No.: 13/137,308

(22) Filed: Aug. 4, 2011

(65) Prior Publication Data

US 2012/0183332 A1 Jul. 19, 2012

(30) Foreign Application Priority Data

Jan. 13, 2011 (KR) ..... 10-2011-0003618

(51) Int. Cl.

| | |
|---|---|
| ***G03G 15/01*** | (2006.01) |
| ***G03G 15/00*** | (2006.01) |
| ***G03G 21/16*** | (2006.01) |
| *G03G 15/08* | (2006.01) |

(52) U.S. Cl.

CPC ..... *G03G 15/0194* (2013.01); *G03G 15/80* (2013.01); *G03G 21/1652* (2013.01); *G03G 15/0126* (2013.01); *G03G 2215/0119* (2013.01); *G03G 15/0896* (2013.01); *G03G 2215/0141* (2013.01); *G03G 2221/1636* (2013.01); *G03G 2221/166* (2013.01); *G03G 2221/1684* (2013.01)

USPC ..... 399/228; 399/234

(58) Field of Classification Search

CPC ..... G03G 15/0194
USPC ..... 399/228, 234
See application file for complete search history.

(56) References Cited

U.S. PATENT DOCUMENTS

| | | | | |
|---|---|---|---|---|
| 5,404,213 | A * | 4/1995 | Okano et al. | 399/127 |
| 6,157,794 | A * | 12/2000 | Katsumi et al. | 399/53 |
| 8,068,752 | B2 * | 11/2011 | Sugiyama | 399/53 |
| 2007/0177899 | A1 * | 8/2007 | Kawamura | 399/223 |
| 2014/0016953 | A1 * | 1/2014 | Yoshida et al. | 399/26 |
| 2014/0153946 | A1 * | 6/2014 | Kobayashi et al. | 399/66 |
| 2014/0169833 | A1 * | 6/2014 | Kawamura et al. | 399/222 |

* cited by examiner

*Primary Examiner* — David Gray
*Assistant Examiner* — Geoffrey Evans
(74) *Attorney, Agent, or Firm* — Staas & Halsey LLP

(57) ABSTRACT

An image forming apparatus includes a main body; at least one developer including an image carrier unit having an image carrier and a charged body charging the image carrier, a developing unit installed to swing at a predetermined angle with respect to the image carrier unit and having a developing roller, and a pressing member pressing the developing unit so that the developing roller comes in contact with the image carrier, and separably installed in the main body; a nip separation unit installed in the main body on one side of the developer to swing the developing unit so that the developing unit is in a position that is separated from the image carrier; and a control unit controlling the developer and the nip separation unit according to a print command.

17 Claims, 15 Drawing Sheets

IMAGE FORMING APPARATUS

CROSS-REFERENCE TO RELATED APPLICATIONS

This application claims priority under 35 U.S.C. §119(a) to Korean Patent Application No. 10-2011-0003618, filed on Jan. 13, 2011, in the Korean Intellectual Property Office, the disclosure of which is incorporated herein by reference.

BACKGROUND

1. Field

The present disclosure relates generally to an image forming apparatus, and more particularly, to a development apparatus that is used in an electro-photographic image forming apparatus.

2. Description of the Related Art

In general, an electro-photographic image forming apparatus, such as a laser printer, a facsimile machine, a copy machine, or the like, is a printing apparatus which forms an electrostatic latent image on an image carrier, develops the electrostatic latent image with a developing agent, and transfers a developer image onto a printing medium.

A developer that is used in the image forming apparatus includes an image carrier on which an electrostatic latent image is formed by an exposure unit and a developing member supplying a developing agent to the image carrier and developing the electrostatic latent image as a developer image. A method of developing the electrostatic latent image on the image carrier through the developing member may be classified into a contact type in which the developing member comes in contact with the image carrier and a non-contact type in which the developing member does not come in contact with the image carrier.

The contact type developer is so configured that a developing member 101 is separated from an image carrier 100 for a predetermined distance as illustrated in FIG. 1A before developing, and the developing member 101 moves in a direction B and comes in contact with the image carrier as illustrated in FIG. 1B during developing. Here, a reference numeral 103 denotes light that is emitted from an exposure unit. When the developing is finished, the developing member 101 is separated from the image carrier 100 for a predetermined distance as illustrated in FIG. 1A. Accordingly, when the developer is driven, a charging voltage is applied to a charging member 102, and the developing member 101 comes in contact with the image carrier 100 to be rotated. At this time, an outer circumference A of the image carrier 100 between the charging member 102 and the developing member 101 comes in contact with the developing member 101 in a non-charging state. When the non-charging section A of the image carrier 100 comes in contact with the developing member 101, the developing agent moves to the image carrier 100. Because of this, image pollution occurs due to the developing agent that has moved to the non-charging section A, and unnecessary consumption of the developing agent occurs to increase the waste developing agent.

In order to remove the developing agent that is attached to the non-charging section in the related art, cleaning blades are installed on the image carrier and a transfer belt. However, according to this method, it is required to prepare waste developing agent chambers having a space of a predetermined size for accommodating the waste developing agent therein on the sides of the image carrier and the transfer belt, and this causes the sizes of the developer and the image forming apparatus to be increased. Also, since the developing agent is attached to the non-charging section, the amount of consumption of the developing agent becomes larger. Accordingly, the maintenance cost is increased and the design of the developer is limited.

Also, according to the image forming apparatus in the related art, a zener diode is installed on the ground of the image carrier to heighten the electric potential of the non-charging section from 0V to −100 to −150V, and thus the non-charging section does not occur. However, this method has the problem that the material cost is increased due to the installation cost of the zener diode. Also, the deviation of the electric potential of the electrostatic latent image on the image carrier for each developer is increased due to the characteristic of the zener diode, and thus it is difficult to obtain a uniform image quality.

SUMMARY

The present disclosure has been made to address at least the above problems and/or disadvantages and to provide at least the advantages described below. Accordingly, an aspect of the present disclosure provides an image forming apparatus and a method for controlling the same, which can remove the non-charging section of the image carrier of the developer.

According to one aspect of the present disclosure, an image forming apparatus includes a main body of the image forming apparatus; at least one developer including an image carrier unit having an image carrier and a charged body charging the image carrier, a developing unit installed to swing at a predetermined angle with respect to the image carrier unit and having a developing roller, and a pressing member pressing the developing unit so that the developing roller comes in contact with the image carrier, and separably installed in the main body; a nip separation unit installed in the main body on one side of the developer to swing the developing unit so that the developing unit is in a position that is separated from the image carrier; and a control unit to control the developer and the nip separation unit according to a print command; wherein the control unit makes the nip separation unit swing the developing unit so that the developing roller is in the position that is separated from the image carrier during a standby state, and if the print command is received, the control unit rotates the image carrier and the developing roller and then controls the nip separation unit so that the image carrier is rotated as much as an angle between the charged body and the developing roller, and then the developing roller in a rotating state comes in contact with the image carrier.

Here, the at least one developer may include a first developer, a second developer, a third developer, and a fourth developer, and the control unit controls the nip separation unit, so that respective developing rollers of the first to fourth developers are separated from corresponding image carriers in a preparatory mode.

The control unit may control the nip separation unit, so that the respective developing rollers of the first to fourth developers come in contact with the corresponding image carriers in a color image mode, and may control the nip separation unit, so that the respective developing rollers of the first to third developers are separated from the corresponding image carriers and the developing roller of the fourth developer comes in contact with the corresponding image carrier in a mono image mode.

The nip separation unit may include a guide plate installed in the main body of the image forming apparatus; a first sliding member slidably installed on the guide plate to swing the fourth developer; a second sliding member slidably installed with respect to the guide plate and the first sliding member to swing the first to third developer; and a separation cam installed between the first and second sliding members to move the first and second sliding members.

The separation cam may include a first cam unit pushing the first and second sliding member in one direction; a second cam unit pushing only the second sliding member in the one direction; and a third cam unit that does not push the first and second sliding members.

A first cam groove to accommodate the separation cam may be formed on a surface of the first sliding member that is opposite to the second sliding member, a second cam groove to accommodate the separation cam may be formed on a surface of the second sliding member that is opposite to the first sliding member, and the separation cam may be installed in a cam space formed by the first and second cam grooves.

A first cam contact unit that comes in contact with the separation cam may be formed in the first cam groove of the first sliding member, and a second cam contact unit that comes in contact with the separation cam may be formed in the second cam groove of the second sliding member.

The first sliding member may include a first sliding body slidably installed on the guide plate; and a first projection member fixed to the first sliding body and having a pressing projection formed thereon to swing the fourth developer.

The second sliding member may include a second sliding body slidably installed with respect to the guide plate and the first sliding member; and a second projection member fixed to the second sliding body and having pressing projections formed thereon to swing the first to third developers.

A pressed projection that comes in contact with the nip separation unit may be formed at a lower end of the developing unit.

The developing unit may swing around a developing coupler receiving a driving power from a developing driving coupler installed in the main body, and a rotating shaft of the developing roller may be apart from a center shaft of the developing coupler.

The control unit may control the nip separation unit so that the developing roller becomes apart from the image carrier in a state where the developing roller and the image carrier are rotated.

The control unit may control the first to fourth developers in a successive circular order of a standby mode, a color image mode, and a mono image mode.

According to another aspect of the present disclosure, a method of controlling an image forming apparatus including a developing roller and an image carrier, which can come in contact with or can be separated from each other, and at least one developer, so that the developing roller is separated from the image carrier in a preparatory mode is provided, the method including receiving a print command; rotating the image carrier and the developing roller; making the developing roller in contact with the image carrier after the image carrier is rotated as much as an angle between the developing roller and a charged body; separating the developing roller from the image carrier if developing of an electrostatic latent image formed on the image carrier is completed; and stopping the rotation of the developing roller and the image carrier.

The at least one developer may include a yellow image developer, a magenta image developer, a cyan image developer, and a black image developer, and respective developing rollers of the yellow image developer, the magenta image developer, the cyan image developer, and the black image developer may come in contact with the image carrier in a color image mode.

The respective developing rollers of the yellow image developer, the magenta image developer, and the cyan image developer may be separated from the image carrier, and the developing roller of the black image developer may come in contact with the image carrier in a mono image mode.

BRIEF DESCRIPTION OF THE DRAWINGS

The above and other aspects, features and advantages of the present disclosure will be more apparent from the following detailed description when taken in conjunction with the accompanying drawings, in which:

FIGS. 1A and 1B are diagrams illustrating the operation of a contact type developer, in which FIG. 1A illustrates a case where the developer is in a stop state, and FIG. 1B illustrates a case where the developer performs developing;

DETAILED DESCRIPTION

Figure 1A:
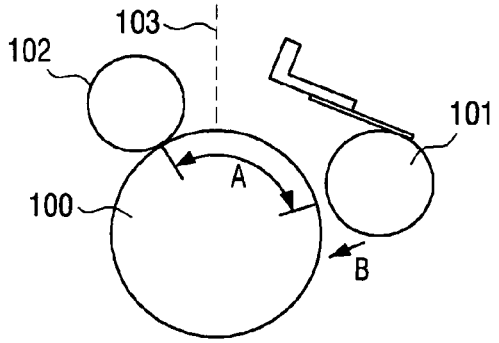
FIG. 1A Related Art

Hereinafter, embodiments of the present disclosure will be described in detail with reference to the accompanying drawings. The aspects and features of the disclosure and methods for achieving the aspects and features will be apparent by referring to the embodiments to be described in detail with reference to the accompanying drawings. However, the embodiments are not limited to the embodiments disclosed hereinafter, but can be implemented in diverse forms. In the following description of the present disclosure, well-known element structures and technologies are not described in detail since they would obscure the invention in unnecessary detail. Also, in the drawings, sizes and relative sizes of some constituent elements may be exaggerated for clarity in explanation.

Figure 2:
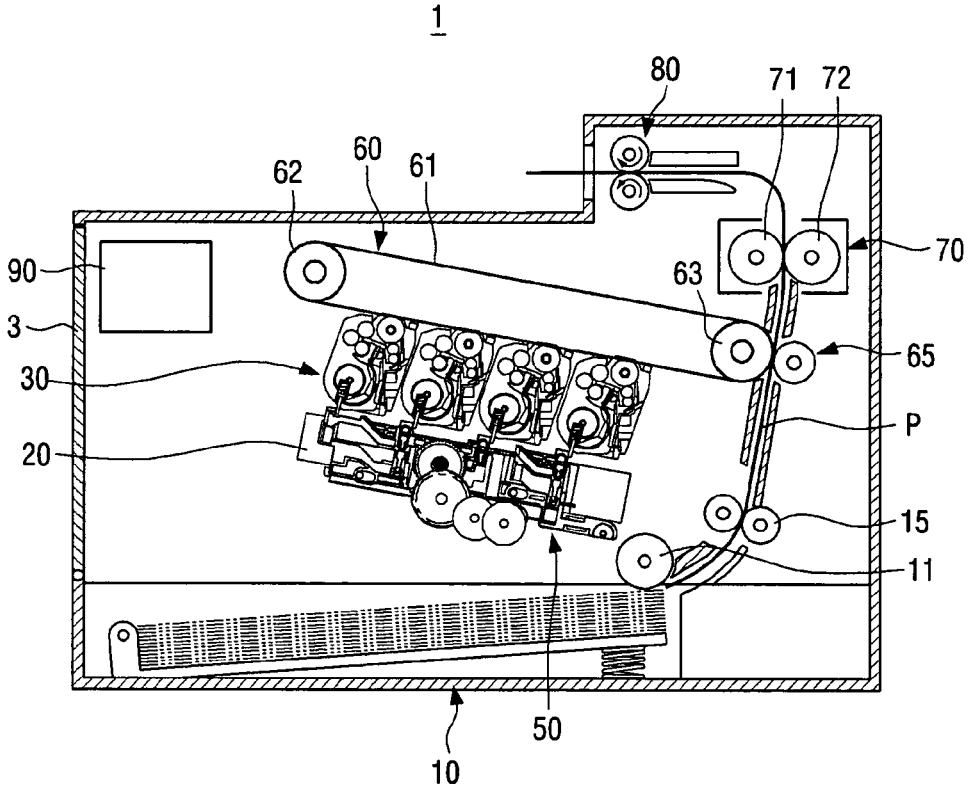
FIG. 2 is a cross-sectional view briefly illustrating an image forming apparatus according to an embodiment of the present disclosure.
Figure 3:
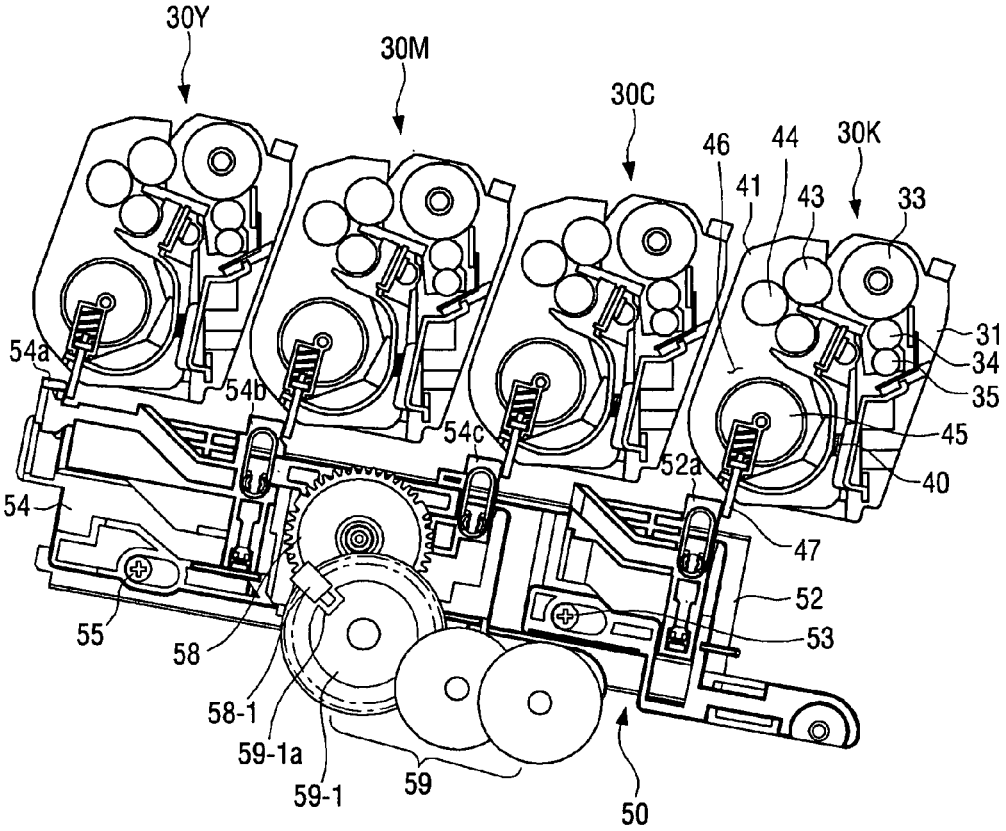
FIG. 3 is a view illustrating a plurality of developers and a nip separation unit in the case where the image forming apparatus of FIG. 2 is in a preparation mode.
Figure 4:
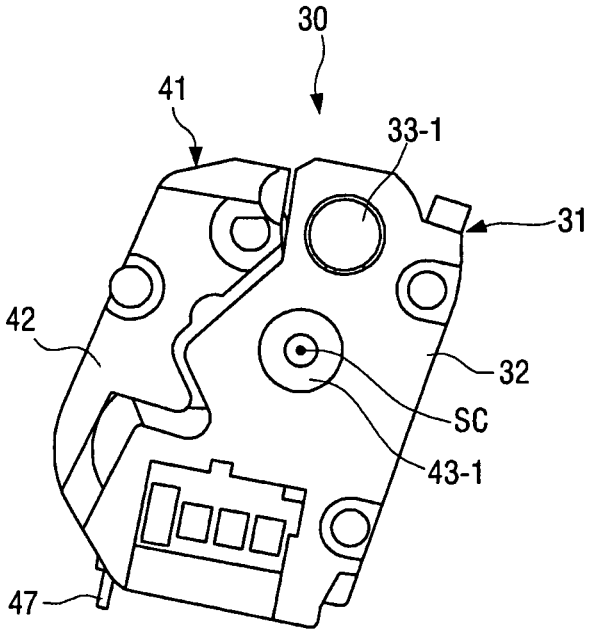
FIG. 4 is a side view of a developer that is used in the image forming apparatus of FIG. 2.
Figure 5:
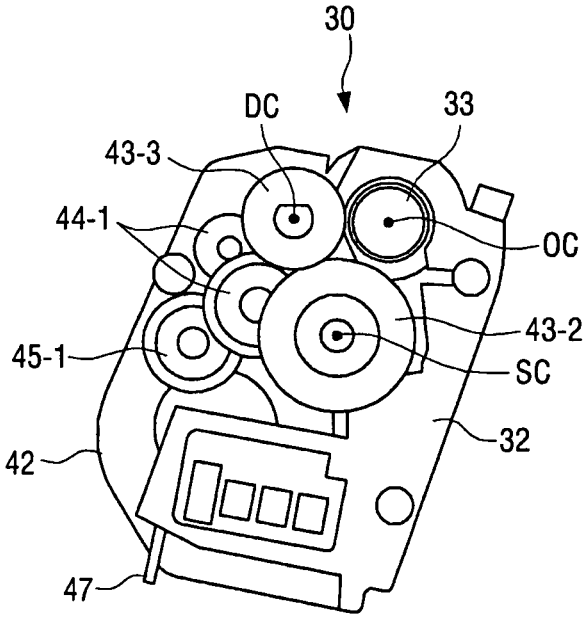
FIG. 5 is a view illustrating a driving gear train of the developer of FIG. 4.

FIG. 2 is a cross-sectional view briefly illustrating an image forming apparatus according to an embodiment of the present disclosure. FIG. 3 is a view illustrating four developers installed in the image forming apparatus of FIG. 2, and illustrates the relationship between the four developers and the nip separation unit in a preparation mode. FIG. 4 is a side view of a developer that is used in the image forming apparatus of FIG. 2, and FIG. 5 is a view illustrating a driving gear train of the developer of FIG. 4.

Referring to FIGS. 2 and 3, an image forming apparatus 1 according to an embodiment of the present disclosure includes a main body 3, a feeder unit 10, an exposure unit 20, a plurality of developers 30, a nip separation unit 50, a transfer belt unit 60, a transfer roller 65, a fusing unit 70, a delivery roller 80, and a control unit 90.

The feeder unit 10 accommodates a predetermined number of sheets of printing media, and includes a pickup roller 11 that picks up and supplies the printing media sheet by sheet. In front of the pickup roller 11 in a direction in which the picked printing media P is transported, a transport roller 15 is installed to transport the picked printing media P to the transfer roller 65.

The exposure unit 20 forms an electrostatic latent image on the image carrier 33 of the plurality of developers 30 through emission of light that corresponds to the received print data.

The plurality of developers 30 form developer images that correspond to the print data, and may include four developers that form a color image, that is, a first developer 30Y, a second developer 30M, a third developer 30C, and a fourth developer 30K. Here, the first to fourth developers 30Y, 30M, 30C, and 30K can form yellow, magenta, cyan, and black developer images, respectively.

The four developers 30Y, 30M, 30C, and 30K are separably installed in the main body 10 of the image forming apparatus 1, and include image carrier units 31 and developing units 41 which can swing at a predetermined angle. Since the four developers 30Y, 30M, 30C, and 30K have the same structure, the fourth developer 30K for forming a black image will be hereinafter described as an example. The reference numeral of the developer will be designated as "30" unless discrimination is necessary.

Figure 6:
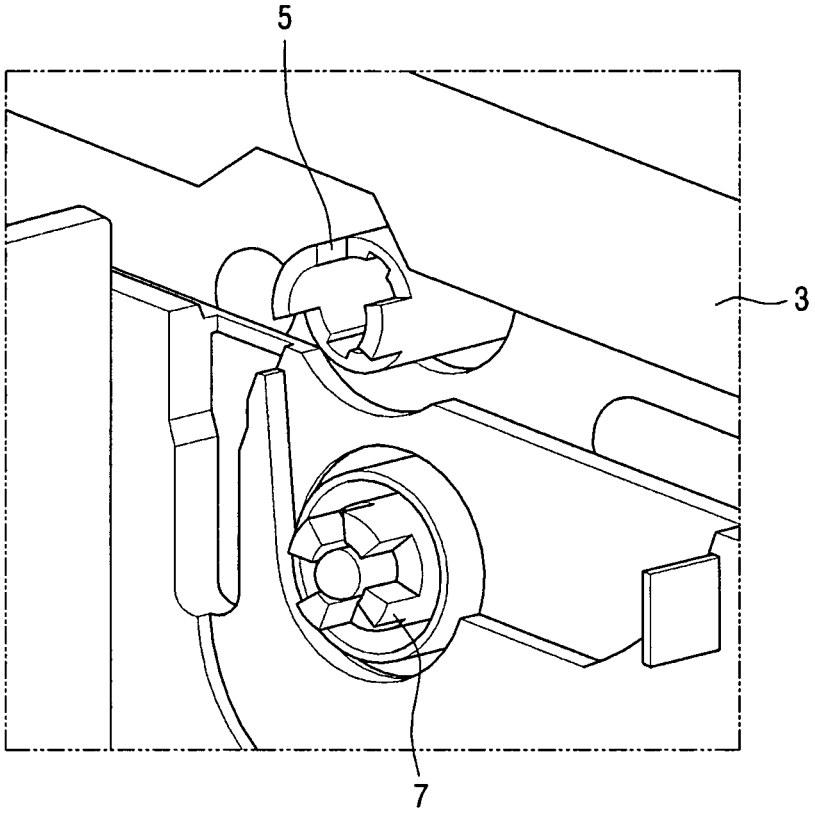
FIG. 6 is a partial perspective view illustrating a developer driving coupler installed in a main body of the image forming apparatus of FIG. 2.

The image carrier unit 31 may include the image carrier 33 and a charged body 34 that charges the image carrier 33. An electrostatic latent image is formed on the surface of the image carrier 33 by the light emitted from the exposure unit 20. A photosensitive drum may be used as the image carrier 33, and a charge roller may be used as the charged body 34. Referring to FIGS. 4 and 5, the image carrier unit 31 may include a first housing 32 that rotatably support the image carrier 33 and the charged body 34. On one side of the first housing 32, an image carrier coupler 33-1, which receives the driving power from an image carrier driving coupler 5 (see FIG. 6) installed in the main body 10, is installed. Accordingly, if the image carrier driving coupler 5 is rotated, the image carrier coupler 33-1 is rotated to rotate the image carrier 33. At this time, the rotating center of the image carrier 33 is OC (see FIG. 5). Also, inside the first housing 32, a charged body cleaning member 35 that cleans the surface of the charged body 34 may be further installed.

Referring to FIGS. 3 and 4, the developing unit 41 is installed to swing at predetermined angle with respect to the image carrier unit 31, and includes a developing roller 43, a developer supply roller 44, and an agitator 45. The developing unit 41 rotatably supports the developing roller 43, the developer supply roller 44, and the agitator 45, and may include a second housing 42 in which a developer space 46 for storing a predetermined developing agent is formed. The second housing 42 is formed to swing at a predetermined angle with respect to the first housing 32. On one side of the second housing 42, a developing coupler 43-1 that receives a driving power from the developing driving coupler 7 installed in the main body 3 is installed. Accordingly, the second housing 42 is formed to swing around the developing coupler 43-1 with respect to the first housing. As illustrated in FIG. 5, a plurality of gears 43-2, 43-3, 44-1, and 45-1 delivering a driving power to the developing roller 43, the developer supply roller 44, and the agitator 45 is connected to the developing coupler 43-1 as illustrated in FIG. 5. Accordingly, if the developing coupler 43-1 is rotated by the developing driving coupler 7 installed in the main body, the developing roller 43, the developer supply roller 44, and the agitator 45 are rotated. Accordingly, the developing agent stored in the developer space 6 is supplied to the developing roller 43 through the developer supply roller 44. In this case, the rotating center DC of the developing roller 43 is apart from the rotating center SC of the developing coupler 43-1 so that the developing roller 43 comes in contact with or is separated from the image carrier 33 according to the swing of the second housing 42.

Figure 8:
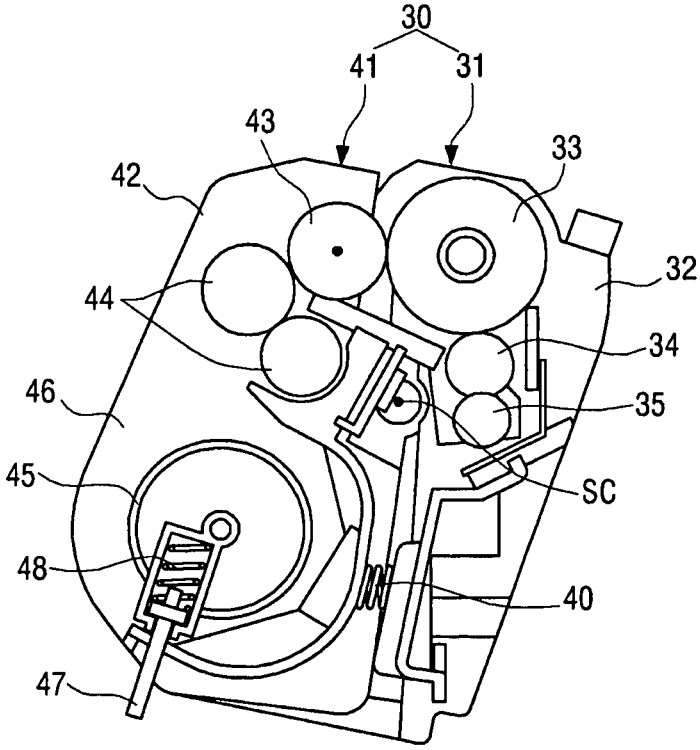
FIG. 8 is a cross-sectional view illustrating a developing roller and an image carrier in a contact state in the developer of FIG. 4.

Also, at the lower end of the second housing 42 of the developing unit 41, a pressed projection 47 that can selectively come in contact with the nip separation unit 50 is formed. The pressed projection 47 may be integrally formed with the second housing 42. The pressed projection 47 may be installed at the lower end of the second housing 42 to be elastically supported by an elastic member 48 such as a spring as illustrated in FIG. 8.

A pressing member 40 is installed between the first housing 32 and the second housing 42. The pressing member 40 is installed between the first housing 32 and the second housing 42 on the opposite side to the developing roller 43 around the developing coupler 43-1 that is the swing center of the second housing 42, and the second housing 42 is elastically supported to rotate clockwise around the developing coupler 43-1. Accordingly, the developing roller 43 installed in the second housing 42 is located in the first position, in which the developing roller 43 comes in contact with the image carrier 33 installed in the first housing 32, by the pressing member 40. A compression coil spring may be used as the pressing member 40.

Figure 7:
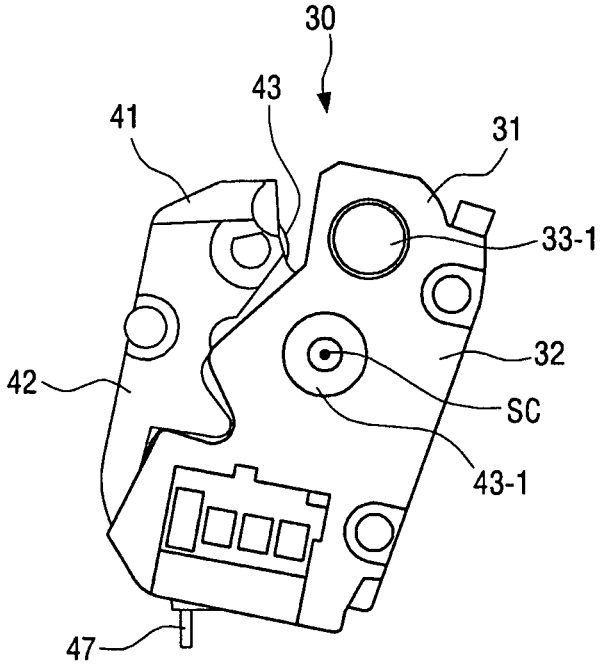
FIG. 7 is a view illustrating a developing roller and an image carrier in a separated state in the developer of FIG. 4.

If the developer 30 as constructed above is mounted on the main body 3, the image carrier coupler 33-1 and the developing coupler 43-1 of the developer 30 are engaged with the image carrier driving coupler 5 and the developing driving coupler 7, respectively. The image carrier coupler 33-1 receives the driving power from the image carrier driving coupler 5, and the developing coupler 43-1 receives the driving power from the developing driving coupler 7. The image carrier driving coupler 5 and the developing driving coupler 7 are independently driven. Also, the positions of the image carrier coupler 33-1 and the developing coupler 43-1 are completely restricted and fixed by the image carrier driving coupler 5 and the development driving coupler 7 in the main body 3. Although the image carrier 33 is restricted and the position thereof is fixed, the development roller 43 can swing at a predetermined angle around the developing coupler 43-1 as illustrated in FIG. 7.

Figure 9:
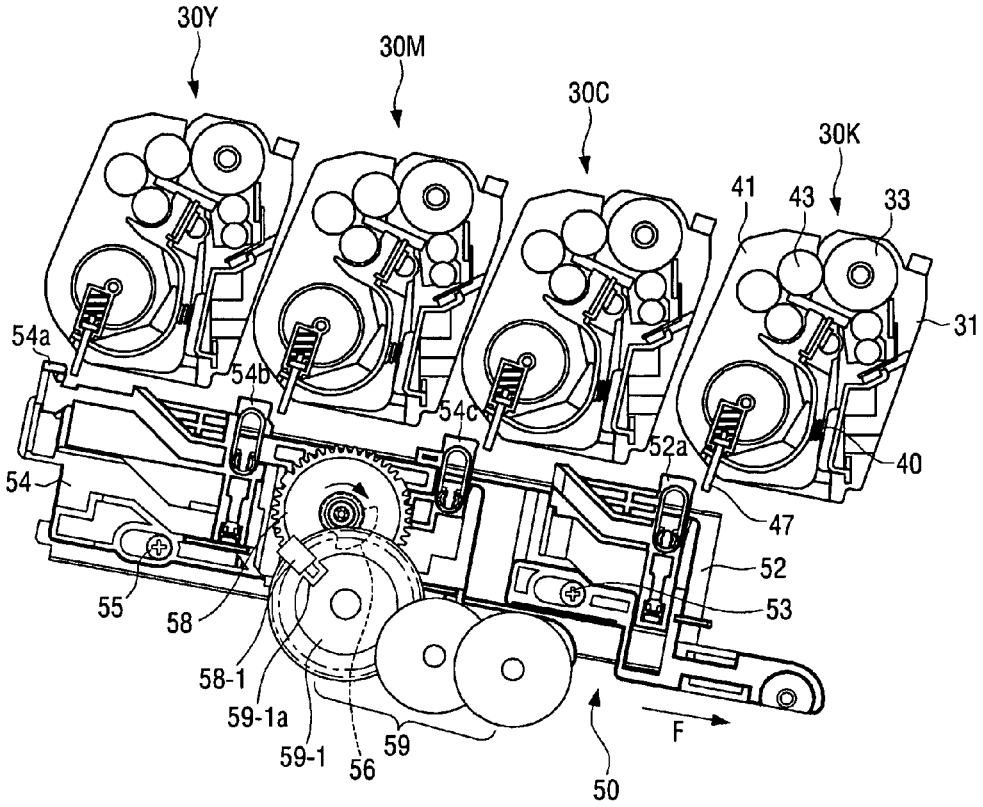
FIG. 9 is a view illustrating a developer and a nip separation unit in a color mode of the image forming apparatus of FIG. 2.
Figure 10:
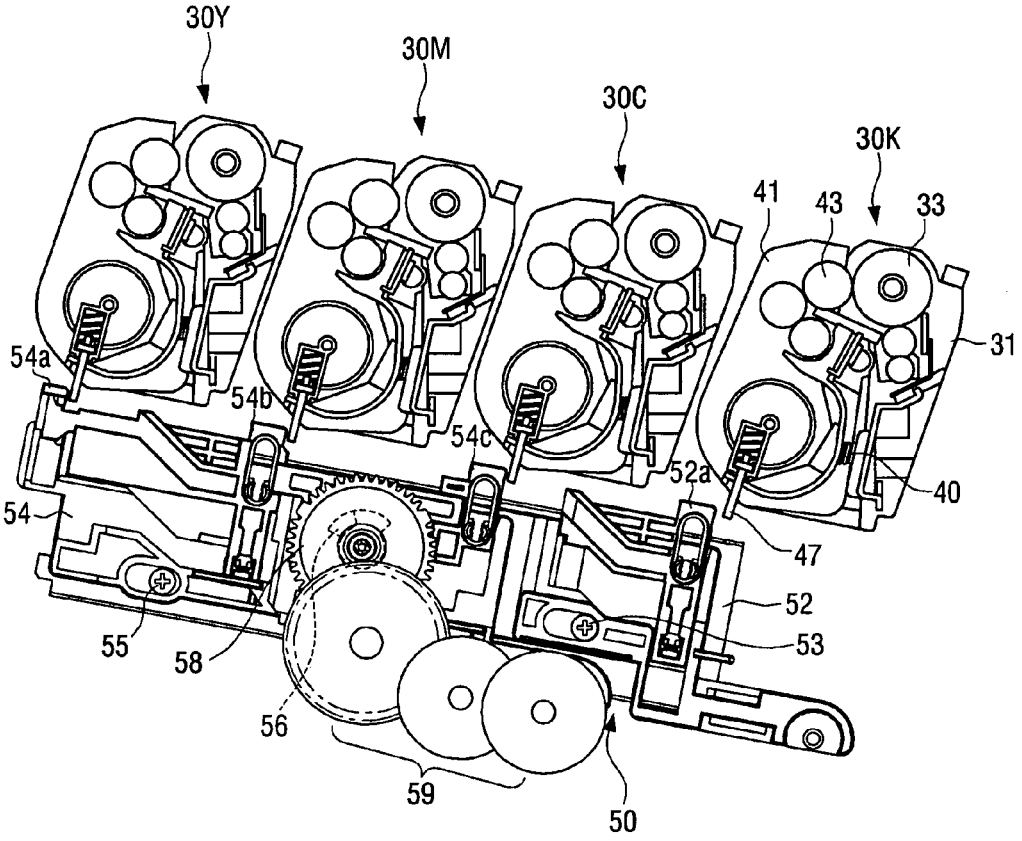
FIG. 10 is a view illustrating a developer and a nip separation unit in a mono mode of the image forming apparatus of FIG. 2.

The nip separation unit 50 is installed in the main body 3 of the image forming apparatus 1, and is formed to swing the developing unit 41 by selectively pressing the pressed projection 47 of the developer 30. Accordingly, the nip separation unit 50 is installed on the lower side of the developer 30 inside the main body 3. If the nip separation unit 50 presses the pressed projection 47, the developing unit 41 is rotated counterclockwise around the developing coupler 43-1. If the developing unit 41 is rotated counterclockwise, the developing roller 43 is located in the second position that is separated from the image carrier 33 as shown in FIG. 9.

Figure 11:
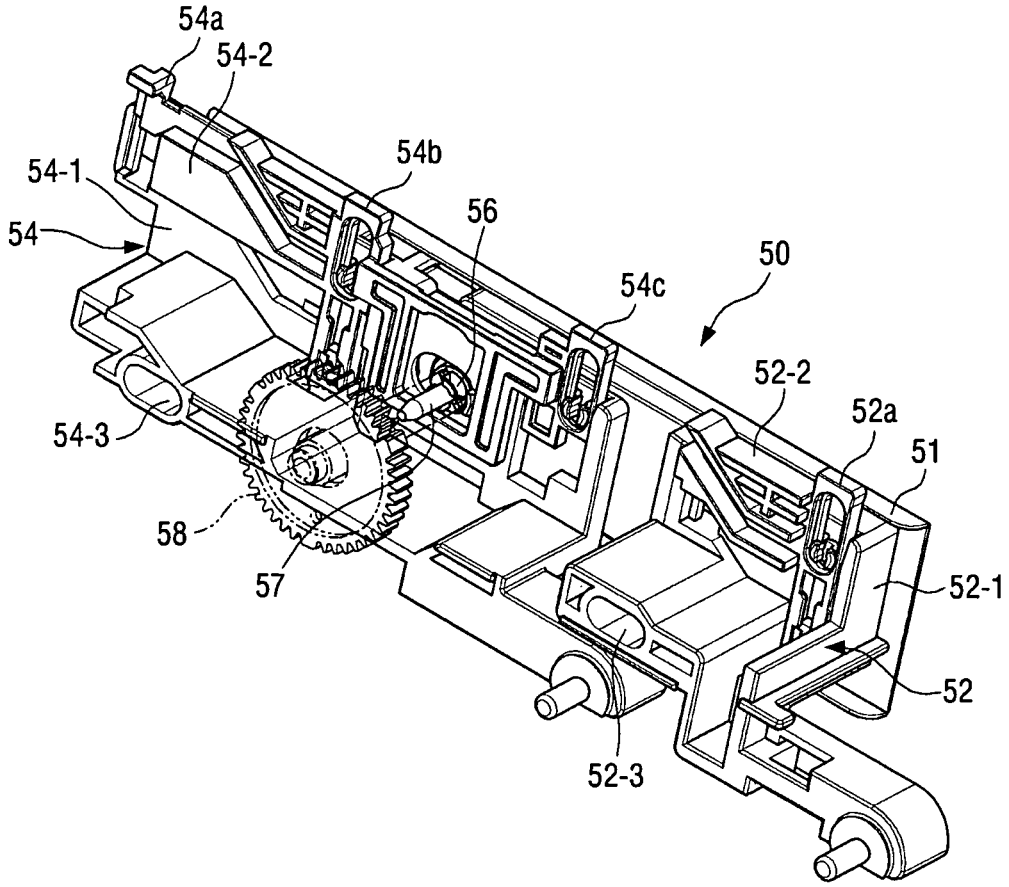
FIG. 11 is a perspective view illustrating an example of a nip separation unit that is used in the image forming apparatus of FIG. 2.
Figure 12:
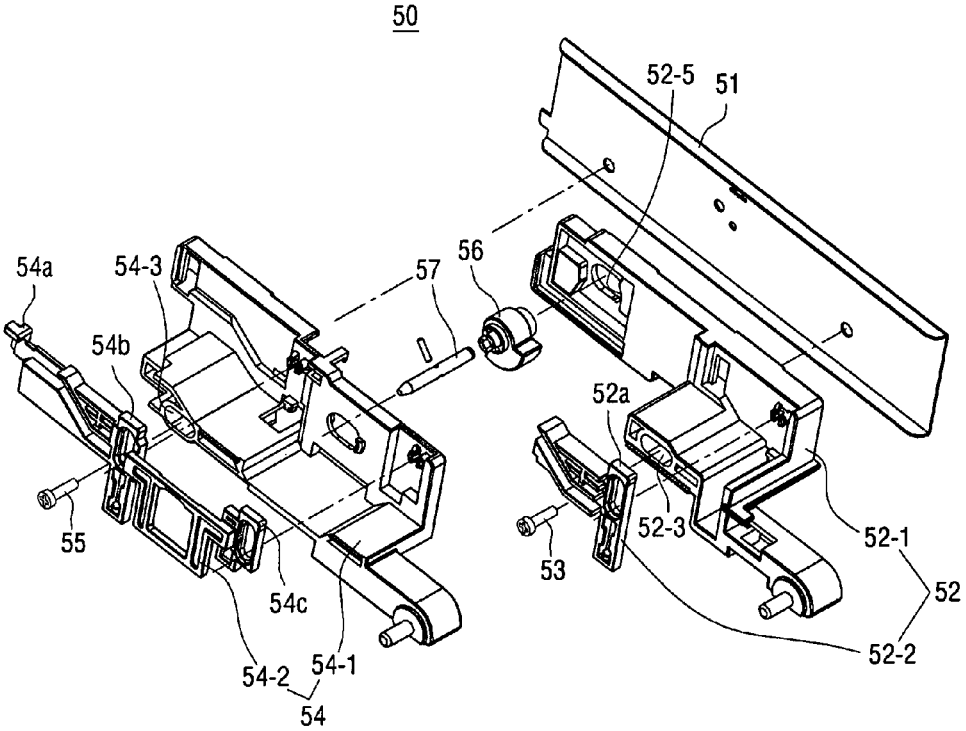
FIG. 12 is an exploded perspective view of the nip separation unit of FIG. 11.

Referring to FIGS. 11 and 12, the nip separation unit 50 may include a guide plate 51, a first sliding member 52, a second sliding member 54, and the separation cam 56.

The guide plate 51 is installed below the developer 30 in the main body 3 of the image forming apparatus 1, and supports the sliding movement of the first and second sliding members 52 and 54.

The first sliding member 52 is slidably installed on the guide plate 51, and is formed to selectively come in contact with the pressed projection 47 of the fourth developer 30K. If the first sliding member 52 presses the pressed projection 47 of the fourth developer 30K, the developing unit 43 of the fourth developer 30K swings counterclockwise around the developing coupler 43-1. The first sliding member 52 may include a first sliding body 52-1, a first projection member 52-2, and a first guide pin 53. The first sliding body 52-1 is slidably installed on the guide plate 51, and forms a first elongated hole 52-3 into which the first guide pin 53 is inserted. The first projection member 52-2 is fixed to the first sliding body 52-1, and includes a pressing projection 52*a* that comes in contact with the pressed projection 47 of the fourth developer 30K to swing the developing unit 41. Accordingly, the first sliding member 52 slides along the guide plate 51 by the first guide pin 53 fixed to the guide plate 51 and the first elongated hole 52-3. If the first sliding member 52 slides, the pressing projection 52*a* of the first projection member 52-2 comes in contact with or is separated from the pressed projection 47 of the fourth developer 30K.

The second sliding member 54 is slidably installed on the upper side of the first sliding member 52 with respect to the first sliding member 52, and is formed to selectively come in contact with the respective pressed projections 47 of the first to third developers 30Y, 30M, and 30C. In this case, a portion of the second sliding member 54 may be directly slidably installed with respect to the guide plate 51. Accordingly, even in the case where the first sliding member 52 does not move, the second sliding member 54 can move with respect to the guide plate 51 and the first sliding member 52. Also, if the second sliding member 54 presses the respective pressed projections 47 of the first to third developers 30Y, 30M, and 30C, the respective developing units 41 of the first to third developers 30Y, 30M, and 30C swing counterclockwise around the developing coupler 43-1.

The second sliding member 54 may include a second sliding body 54-1, a second projection member 54-2, and a second guide pin 55. The second sliding body 54-1 is slidably installed on the guide plate 51 and the first sliding member 52, and forms a second elongated hole 54-3 into which the second guide pin 55 is inserted. The second projection member 54-2 is fixed to the second sliding body 54-1, and includes three pressing projections 54*a*, 54*b*, and 54*c* that come in contact with the respective pressed projections 47 of the first to third developers 30Y, 30M, and 30C to swing the developing unit 41. The three pressing projections 54*a*, 54*b*, and 54*c*, as illustrated in FIG. 12, are formed to be apart for a distance that corresponds to the first to third developers 30Y, 30M, and 30C to the upper side of the second projection member 54-2. Accordingly, the second sliding member 54 slides along the guide plate 51 by the second guide pin 55 fixed to the guide plate 51 and the second elongated hole 54-3. If the second sliding member 54 slides, the three pressing projections 54*a*, 54*b*, and 54*c* of the second projection member 54-2 simultaneously come in contact with or are separated from the respective pressed projections 47 of the first to third developers 30Y, 30M, and 30C.

Figure 14:
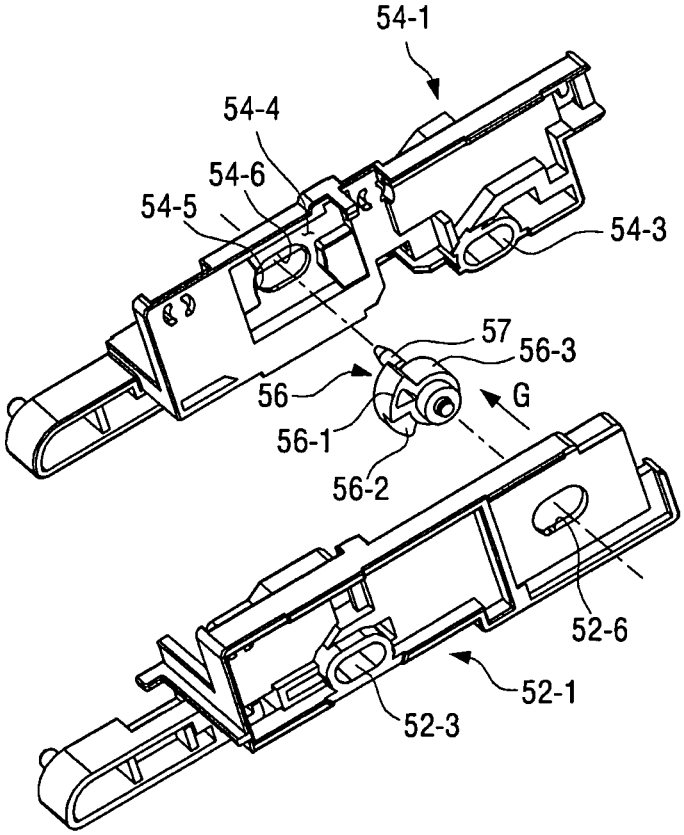
FIG. 14 is an exploded perspective view illustrating a relationship between first and second sliding members of the nip separation unit of FIG. 11 and a separation cam.
Figure 15:
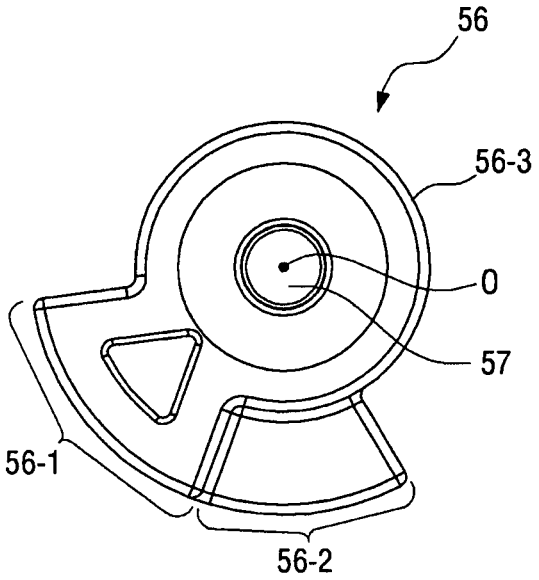
FIG. 15 is a view illustrating a separation cam of the nip separation unit of FIG. 11 as seen from the direction indicated by an arrow G.

The separation cam 56 is rotatably installed between the first and second sliding members 52 and 54, and is formed to move the first and second sliding members 52 and 54. The separation cam 56 is formed to be rotated by a cam shaft 57, and a cam gear 58 is installed at one end of the cam shaft 57 to receive the driving power from a driving source (not illustrated) of the main body 3. Referring to FIGS. 14 and 15, the separation cam 56 includes a first cam unit 56-1 pushing both the first and second sliding members 52 and 54 in one direction, a second cam unit 56-2 pushing only the second sliding member 54 in the same direction, and a third cam unit 56-3 that does not push the first and second sliding members 52 and 54. The first cam unit 56-1 is formed in a circular arc shape having a radius that can simultaneously press the first and second sliding members 52 and 54. The second cam unit 56-2 can press the second sliding member 54 from the first cam unit 56-1, and the first sliding member 52 is extended in a circular arc shape for a predetermined length with a thickness to the extent of non pressing. That is, the second cam unit 56-2 is formed in a stepped circular arc shape from the first cam unit 56-1. Accordingly, the second cam unit 56-2 presses the second sliding member 54, but does not press the first sliding member 52. The third cam unit 56-3 is formed in a circular arc shape having a radius that does not press the first and second sliding members 52 and 54.

Figure 13:
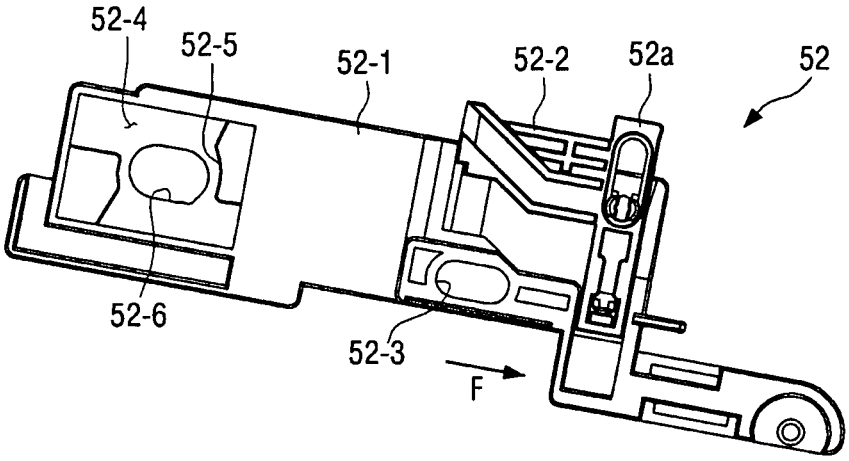
FIG. 13 is a front view of the first sliding member of FIG. 11.

As shown in FIGS. 13 and 14, on a surface that is opposite to the surface that is opposite to the guide plate 51 of the first sliding member 52, that is, on a surface that is opposite to the second sliding member 54, a first cam groove 52-4 for accommodating the separation cam 56 is formed, and on a surface that is opposite to the first sliding member 52 of the second sliding member 54, a second cam groove 54-4 for accommodating the separation cam 56 is formed. Accordingly, if the second sliding member 54 is located on the upper side of the first sliding member 52, a cam space is formed by the first and second cam grooves 52-4 and 54-4. The separation cam 56 is rotatably installed in the cam space.

Figure 16:
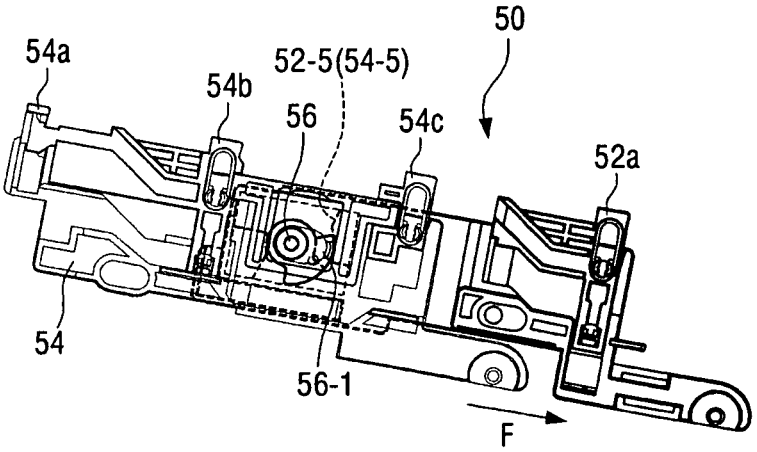
FIGS. 16 to 18 are views illustrating the operation of the nip separation unit of FIG. 11.

In the first cam groove 52-4 of the first sliding member 52, a first hole 52-6 through which the cam shaft 57 passes and the separation cam 56, that is, a first cam contact unit 52-5 that comes in contact with the first cam unit 56-1 of the separation cam 56, are formed. In the second cam groove 54-4 of the second sliding member 54, a second hole 54-6 through which the cam shaft 57 passes and the separation cam 56, that is, a second cam contact unit 54-5 that comes in contact with the first and second cam units 56-1 and 56-2 of the separation cam 56, are formed. Accordingly, if the first cam unit 56-1 of the separation cam 56 comes in contact with the first and second cam contact units 52-5 and 54-5 of the first and second sliding members 52 and 54, as illustrated in FIG. 16, the first and second sliding members 52 and 55 are pushed by the separation cam 56 and move in one direction (a direction indicated by an arrow F). The second cam unit 56-2 of the separation cam 56 does not come in contact with the first cam contact unit 52-5 of the first sliding member 52, but comes in contact with only the second cam contact unit 54-5 of the second sliding member 54 to press the second sliding member 54 in one direction. If the third cam unit 56-3 reaches a position that is opposite to the first and second cam contact units 52-5 and 54-5 of the first and second sliding members 52 and 54, the separation cam 56 does not press the first and second sliding members 52 and 54.

Figure 17:
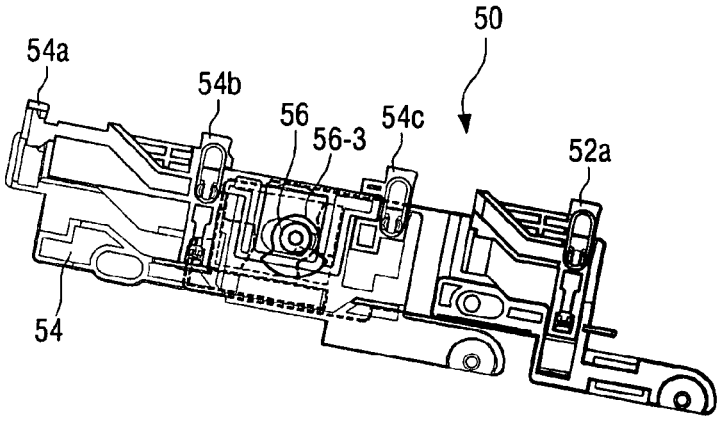
Figure 18:
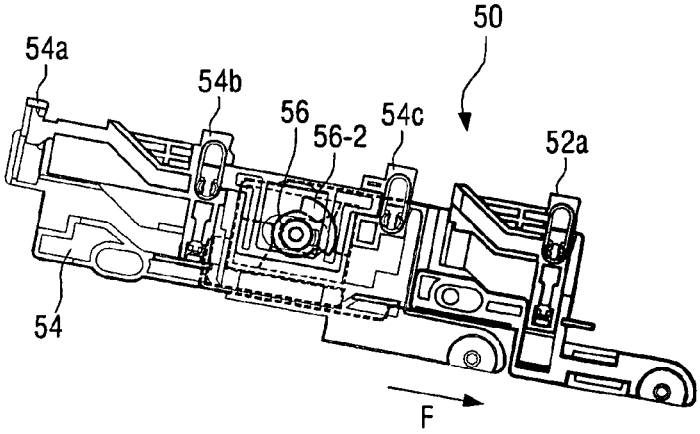

Accordingly, if the separation cam 56 is rotated clockwise in a state where the first cam unit 56-1 of the separation cam 56 comes in contact with the first and second cam contact units 52-5 and 54-5, the third cam unit of the separation cam 56 is opposite to the first and second cam contact units 52-5 and 54-5 as illustrated in FIG. 17. In this state, the first and second sliding members 52 and 54 do not receive force in a direction indicated by an arrow F by the separation cam 56. If the separation cam 56 continues rotation in a state as illustrated in FIG. 17, the second cam unit 56-2 of the separation cam 56 reaches a position in which the second cam unit 56-2 comes in contact with the first and second cam contact units 52-5 and 54-5 of the first and second sliding members 52 and 54. Accordingly, the second cam unit 56-2 of the separation cam 56 pushes only the second sliding member 54 in a direction indicated by an arrow F as illustrated in FIG. 18, but does not push the first sliding member 52. Accordingly, the first sliding member 52 keeps its position.

The cam gear 58 is connected to the driving source (not illustrated) of the main body 3 through a gear train 59, and the rotation of the cam gear 58 is controlled by a stop member 58-1 that can stop the rotation of the gear train 59. The stop member 58-1 may use a solenoid, and if the shaft of the solenoid 58-1 is inserted into the groove 59-1 a formed on the first gear 59-1 of the gear train 59, the rotation of the cam gear 58 is stopped. The control unit 90 controls the stop member 58-1 to control the rotating angle of the cam gear 58, and by this, the rotating angle of the separation cam 56 can be controlled.

Referring again to FIG. 2, the transfer belt unit 60 includes a transfer belt 61, a driving roller 62, and a driven roller 63. The transfer belt 61 repeatedly receives the developer images from the image carriers 33 of the four developers 30Y, 30M, 30C, and 30K, and moves the developer images toward the transfer roller 65. The driving roller 62 and the driven roller 63 support the transfer belt 61, and the transfer belt 61 performs a caterpillar operation.

At one end of the transfer belt unit 60, the transfer roller 65 is installed. The transfer roller 65 transfers the developer image formed on the transfer belt 61 to a printing medium that is supplied from the feeder unit 10 between the transfer roller 65 and the transfer belt 61.

The fusing unit 70 includes a pressing roller 71 and a heating roller 72 that are opposite to each other. The pressing roller 71 and the heating roller 72 apply predetermined heat and pressure to the printing medium P to which the developer image is transferred by the transfer roller 65 to fuse the image.

A delivery roller 80 is formed to discharge a printing medium P on which the image is fused by the transfer roller 65 and the printing is completed to the outside of the main body 3 of the image forming apparatus 1.

The control unit 90 forms the image that corresponds to the received print data on the printing medium by controlling the feeder unit 10, the exposure unit 20, the plurality of developers 30, the nip separation unit 50, the transfer belt unit 60, the transfer roller 65, the fusing unit 70, and the delivery roller 80. During a print standby state, that is, in the preparation mode, the control unit 90 makes the nip separation unit 50 swing the respective developing units 41 of the plurality of developers 30 so that the developing roller 43 is located in the second position that is apart from the image carrier 33. Then, if a print command is received, the control unit 90 rotates the image carrier 33 and the developing roller 43 of at least one developer 30 according to a control mode, and controls the nip separation unit 50 so that the developing roller 43 in a rotating state reaches the first position in which the developing roller 43 comes in contact with the image carrier 33 after the image carrier 33 is rotated at least as much as the angle between the charged body 34 and the developing roller 43.

Hereinafter, the operation of the image forming apparatus 1 having the above-described construction according to the present disclosure will be described in detail with reference to the accompanying drawings.

First, a color image mode in which the image forming apparatus 1 prints a color image will be described.

In the preparation mode before the print start, as illustrated in FIG. 3, the pressing projections 54*a*, 54*b*, 54*c*, and 52*a* of the nip separation unit 50 press the pressed projections 47 of the four developers 30Y, 30M, 30C, and 30K. Accordingly, the respective developing units 41 of the developers 30Y, 30M, 30C, and 30K swing at a predetermined angle around the developing coupler 43-1 that is a swing center, and a portion of the developing unit 41 on the upper side of the developing coupler 43-1 becomes apart from the image carrier 33, and a portion of the developing unit 41 on the lower side of the developing coupler 43-1 becomes close to the image carrier unit 31. Accordingly, in the preparation mode before the printing starts, the respective developing rollers 43 of the developing units 41 of the four developers 30Y, 30M, 30C, and 30K are separated from the image carrier 33, and the pressing member 40 is in compressed state.

If the print command is received (S10), the control unit 90 controls the exposure unit 20 to emit light that corresponds to the print data, and thus electrostatic latent images are formed on surfaces of the image carriers 33 of the four developers 30Y, 30M, 30C, and 30K.

Almost at the same time, a high voltage is applied to the charged body 34 to charge the image carrier 33. Also, the control unit 90 makes the image carriers 33 and the developing rollers 43 of the four developers 30Y, 30M, 30C, and 30K be rotated in a separated state from each other as illustrated in FIG. 2 (S20). The control unit 90 may first drive the image carrier 33 earlier than the developing roller 43 for about 200 msec. At this time, the image carrier 33 receives the driving power from the image carrier driving coupler 5, and the developing roller 43 is rotated by the developing roller gear 43-3 (see FIG. 5) that receives the driving power from the developing driving coupler 7. At this time, since the image carrier 33 and the developing roller 43 are rotated in a state where they are apart from each other to form a gap between them, and thus the developing agent of the developing roller 43 is not attached to the non-charging section on the image carrier 33.

Since the charging is performed in all sections of the surface of the image carrier 33 after the image carrier 33 is rotated as much as the non-charging section between the charged body 34 and the developing roller 43, no further non-charging section exists on the image carrier 33.

Figure 1B:
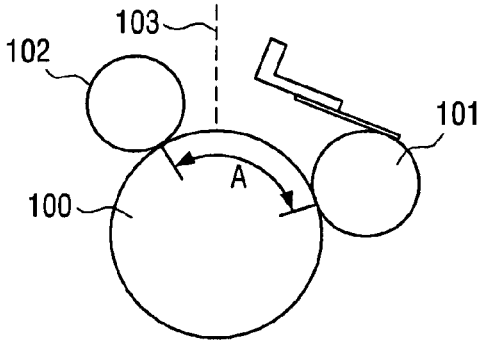
FIG. 1B Related Art

After the image carrier 33 performs one revolution, the control unit 90 controls the nip separation unit 50 so that the developing roller 43 comes in contact with the image carrier 33 (S30) by separating the pressing projections 54*a*, 54*b*, 54*c*, and 52*a* from the pressed projections 47. That is, the control unit 90 rotates the separation cam 56 of the nip separation unit 50 so that the first cam unit 56-1 gets out of the first cam contact unit 52-5 of the first sliding member 52 and the second cam contact unit 54-5 of the second sliding member 54 and the third cam unit 56-3 stands opposite to the first and second cam contact unit 52-5 and 54-5 of the first and second sliding member 52 and 54. In this case, the pressing forces, which are applied from the four pressing projections 54*a*, 54*b*, 54*c*, and 52*a* of the nip separation unit 50 to the pressed projections 47 of the four developers 30Y, 30M, 30C, and 30K, respectively, are removed, and thus the developing units 41 of the respective developers 30 are rotated by the pressing members 40 at a predetermined angle clockwise around the developing coupler 43-1. If the developing units 41 are rotated at the predetermined angle, the rotating developing rollers 43 come in contact with the rotating image carrier 33 (see FIG. 9). In this case, the pressing projections 54*a*, 54*b*, 54*c*, and 52*a* of the first and second sliding members 52 and 54 of the nip separation unit 50, as illustrated in FIG. 9, are located in places that are apart from the pressed projections 47 of the four developers 30Y, 30M, 30C, and 30K by the separation cam 56. The control unit 90 controls the stop member 58-1 to control the rotation of the cam gear 58, and thus the rotating angle of the separation cam 56 can be controlled. Here, it is exemplified that the control unit 90 controls the nip separation unit 50 so that the developing roller 43 comes in contact with the image carrier 33 after the image carrier 33 performs one revolution. However, by controlling the nip separation unit 50 so that the developing roller 43 comes in contact with the image carrier 33 after the image carrier 33 is rotated at least as much as the non-charging section A (see FIGS. 1A and 1B) of the image carrier 33, the developing agent is prevented from being attached to the non-charging section.

If the developing of the electrostatic image formed on the image carrier 33 is completed, the control unit makes the developing rollers 43 of the four developers 30Y, 30M, 30C, and 30K be apart from the image carrier 33 (S40). That is, the control unit 90 makes the first cam unit 56-1 come in contact with the first and second cam contact units 52-5 and 54-5 of the first and second sliding members 52 and 54 by rotating the separation cam 56 clockwise. If the first cam unit 56-1 of the separation cam 56 come in contact with the first and second cam contact units 52-5 and 54-5, the first and second sliding members 52 and 54 move in a direction indicated by an arrow F in FIG. 9. Specifically, since the second cam unit 56-2 exists between the third cam unit 56-3 and the first cam unit 56-1 of the separation cam 56, the separation cam 56 is rotated clockwise, so that the second cam unit 56-2 first comes in contact with the second cam contact unit 54-5 of the second sliding member 54 to move in the direction indicated by the arrow F. If the separation cam 56 continues rotation, the first cam unit 56-1 comes in contact with the first and second cam contact units 52-5 and 54-5 of the first and second sliding members 52 and 54, and thus the first sliding member 52 also moves in the direction indicated by the arrow F. If the first and second sliding members 52 and 54 move in the direction indicated by the arrow F, the four developers 30Y, 30M, 30C, and 30K that correspond to the four pressing projections 54*a*, 54*b*, 54*c*, and 52*a* press the pressed projections 47. If the pressed projections 47 are pressed, the developing units 41 are rotated counterclockwise around the developing coupler 43-1. Accordingly, the pressing members 40 below the developing coupler 43-1 are compressed, and the developing rollers 43 on the upper side of the developing coupler 43-1 are separated from the image carrier 33 and are located in the second position. Thereafter, the control unit 90 stops the rotation of the developing rollers 43 and the image carrier 33 (S50).

The developer images formed by the four developers 30Y, 30M, 30C, and 30K are repeatedly transferred to the transfer belt 61 to form a color image. The color image formed on the transfer belt 61 is transferred to the printing medium P supplied from the feeder unit 10 by the transfer roller 65.

If the printing medium P onto which the color image is transferred passes through the fusing unit 70, the color image is fused on the printing medium P by the heat and pressure that is applied by the fusing unit 70. The printing medium P on which the printing is completed is discharged to the outside of the main body 3 through the delivery roller 80.

Next, a mono image mode in which the image forming apparatus 1 prints a black/white image will be described.

Since a process of operating only one developer 30K that forms a black image among the four developers 30Y, 30M, 30C, and 30K is different from the above-described color image forming process, a process of operating only one developer 30K using the nip separation unit 50 will be described hereinafter.

In the case of the mono image mode, the control unit 90 rotates the developing roller 43 and the image carrier 33, and then controls the nip separation unit 50 so that the three developers 30Y, 30M, and 30C that form yellow, magenta, and cyan images maintain the second position in which the developing roller 43 and the image carrier 33 are apart from each other, and only the developing roller 43 of the developer 30K that forms a black image comes in contact with the image carrier 33. That is, the control unit 90 rotates the separation cam 56 clockwise so that the first cam unit 56-1 gets out of the first and second cam contact units 52-5 and 54-5 of the first and second sliding members 52 and 54 and the third cam unit 56-3 stands opposite to the first and second cam contact unit 52-5 and 54-5, In this case, the developing units 41 are rotated clockwise at a predetermined angle by the pressing members 40 of the four developers 30Y, 30M, 30C, and 30K, and thus the developing rollers 43 come in contact with the image carrier 33. If the separation cam 56 continues rotation, the second cam unit 56-2 comes in contact with the second cam contact unit 54-5 of the second sliding member 54. Accordingly, the second sliding member 54 moves in the direction indicated by the arrow F, and the first sliding member 52 maintains its current position. If the second sliding member 54 move in the direction indicated by the arrow F, the pressed projections 47 of the three developers 30Y, 30M, and 30C are pressed by the pressing projections 54*a*, 54*b*, and 54*c*. If the pressed projections 47 are pressed, the developing unit 41 of the developer 30 is rotated counterclockwise around the developing coupler 43-1. If the developing unit 41 is rotated counterclockwise around the developing coupler 43-1, the pressing member 40 below the developing coupler 43-1 is compressed, and the developing roller 43 on the upper side of the developing coupler 43-1 is separated from the image carrier 33. If the second cam unit 56-2 of the separation cam 56 comes in contact with the second cam contact unit 54-5 of the second sliding member 54, the control unit 90 stops the separation cam 56. Accordingly, the three developers 30Y, 30M, and 30C that form yellow, magenta, and cyan images maintain the position in which the developing roller 43 and the image carrier 33 are apart from each other, and only the developer 30K that forms a black image maintains the position in which the developing roller 43 and the image carrier 33 comes in contact with each other. Accordingly, the developer 30K can form the black/white image.

If the print of the black/white image is completed, the control unit 90 rotates the separation cam 56 clock wise. Accordingly, the second cam unit 56-2 of the separation cam 56 gets out of the first and second cam contact units 52-5 and 54-5 of the first and second sliding members 52 and 54, and the first cam unit 56-1 is located in the position. Accordingly, the first sliding member 52 is also pushed in the direction indicated by the arrow F by the first cam unit 56-1 of the separation cam 56. In this case, the pressed projection 47 of the fourth developer 30K is pressed by the pressing projection 52*a* of the first sliding member 52. If the pressed projection 47 is pressed, the developing unit 41 is rotated counterclockwise around the developing coupler 43-1, and the developing roller 43 is separated from the image carrier 33. Thereafter, the control unit 90 stops the rotation of the developing roller 43 and the image carrier 33.

As described above, it is exemplified that the image forming apparatus 1 performs a control operation using the nip separation unit 50 that controls contact and separation of the developing rollers 43 of the four developers 30Y, 30M, 30C, and 30K and the image carrier 33 by one driving source. However, the method of controlling the contact and separation of the developing roller 43 is not limited thereto.

As another example, the contact and the separation of the developing rollers of the four developers 30Y, 30M, 30C, and 30K may be controlled using separate nip separate members. An example of the nip separation member and the developers is illustrated in FIG. 19.

Figure 19:
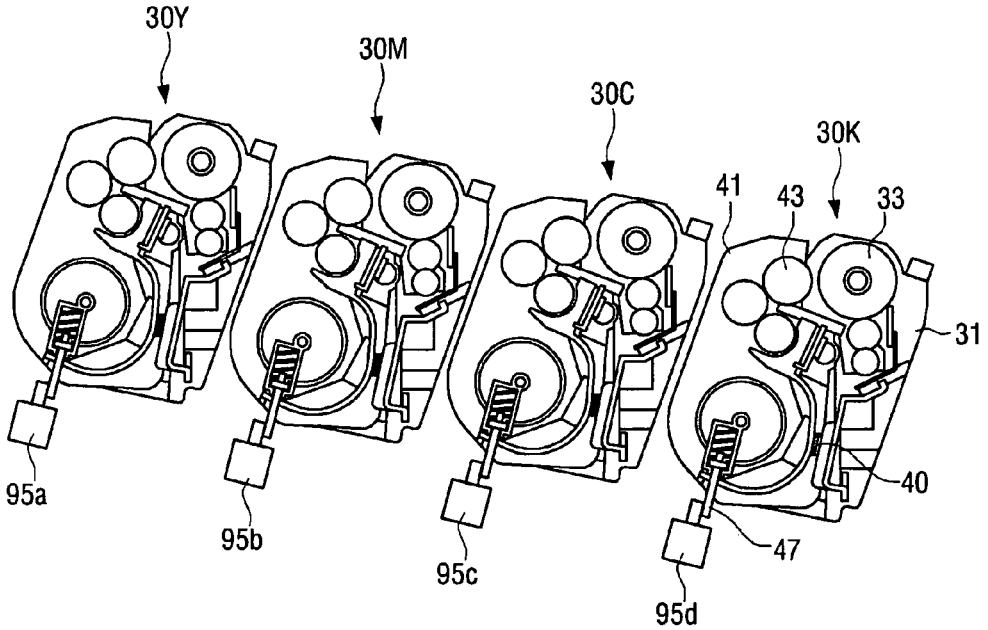
FIG. 19 is a view illustrating another example of a nip separation unit used in an image forming apparatus according to an embodiment of the present disclosure.
Figure 20:
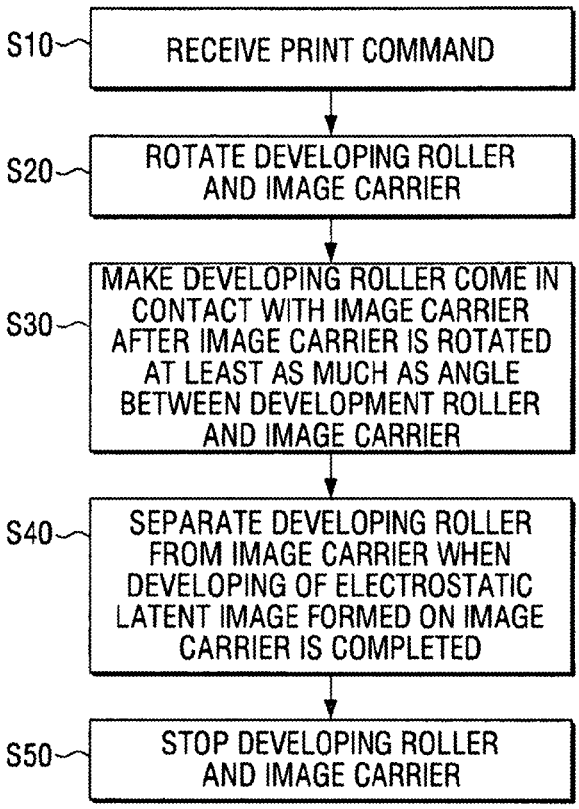
FIG. 20 is a flowchart illustrating a method of controlling an image forming apparatus according to an embodiment of the present disclosure.

Referring to FIG. 19, on one side of the pressed projections 47 of the four developers 30Y, 30M, 30C, and 30K, four nip separation members 95*a*, 95*b*, 95*c*, and 95*d* are installed. Accordingly, the respective pressed projections 47 can be pressed by the nip separation members 95*a*, 95*b*, 95*c*, and 95*d*. In a preparation step before the printing, the four nip separation members 95*a*, 95*b*, 95*c*, and 95*d* press the corresponding pressed projections 47, and the developing roller 43 is apart from the image carrier 33.

In case of forming a color image, the control unit 90 rotates the developing rollers 43 of the developers 30Y, 30M, 30C, and 30K and the image carrier 33, and then controls the first to four nip separation members 95*a*, 95*b*, 95*c*, and 95*d* so that the pressed projections 47 are not pressed. Accordingly, the developing unit 41 swings at a predetermined angle by the pressing member 40, and the rotating developing roller 43 comes in contact with the rotating image carrier 33.

In the case of forming a black/white image, the control unit 90 rotates the developing rollers 43 of the developers 30Y, 30M, 30C, and 30K and the image carrier 33, and then controls the first to four nip separation members 95*a*, 95*b*, 95*c*, and 95*d* so that the first to third nip separation member 95*a*, 95*b*, and 95*c* maintain their current state, and only the fourth nip separation member 95*d* is controlled not to press the pressed projections 47 of the fourth developer 30K. Accordingly, the rotating developing roller 43 of the fourth developer 30K comes in contact with the rotating image carrier 33 to form the black/white image.

As described above, it is exemplified that the image forming apparatus 1 includes fourth developers 30Y, 30M, 30C, and 30K and forms a color image. However, the present disclosure can be applied to a mono image forming apparatus including only one developer.

As described above, according to the present disclosure, when the developer forms an image, the developing roller and the image carrier are first rotated, and after the image carrier is rotated so that the non-charging section of the image carrier passes the contact point with the developing roller, the rotating developing roller comes in contact with the rotating image carrier to prevent the developing agent from being attached to the non-charging section. Accordingly, it is not necessary to prepare a waste developer chamber that accommodates the waste developing agent that is removed from the image carrier and the transfer belt, and thus the developer and the image forming apparatus can be miniaturized. Also, since there is no developing agent that is attached to the non-charging section, the amount of consumption of the developing agent is reduced, and thus the maintenance cost can be reduced. Also, a uniform image quality can be obtained.

While the present disclosure has been shown and described with reference to certain embodiments thereof, it will be understood by those skilled in the art that various changes in form and detail may be made therein without departing from the spirit and scope of the invention, as defined by the appended claims.

What is claimed is:

1. An image forming apparatus comprising:

a main body of the image forming apparatus;

at least one developer including an image carrier unit having an image carrier and a charged body charging the image carrier, a developing unit installed to swing at a predetermined angle with respect to the image carrier unit and having a developing roller, and a pressing member pressing the developing unit so that the developing roller comes in contact with the image carrier, and separably installed in the main body;

a nip separation unit installed in the main body on one side of the developer to swing the developing unit so that the developing unit is in a position that is separated from the image carrier; and a control unit to control the developer and the nip separation unit according to a print command, wherein the developing unit is configured to swing around a developing coupler receiving a driving power from a developing driving coupler installed in the main body, wherein the control unit makes the nip separation unit swing the developing unit around the developing coupler so that the developing roller is in the position that is separated from the image carrier during a standby state, and if the print command is received, the control unit rotates the image carrier and the developing roller and then controls the nip separation unit so that the image carrier is rotated as much as an angle between the charged body and the developing roller, and then the developing roller in a rotating state comes in contact with the image carrier.

2. The image forming apparatus as claimed in claim 1, wherein the at least one developer comprises a first developer, a second developer, a third developer, and a fourth developer, and the control unit controls the nip separation unit, so that respective developing rollers of the first to fourth developers are separated from corresponding image carriers in a preparatory mode.

3. The image forming apparatus as claimed in claim 2, wherein the control unit controls the nip separation unit, so that the respective developing rollers of the first to third developers are separated from the corresponding image carriers and the developing roller of the fourth developer comes in contact with the corresponding image carrier in a mono image mode.

4. The image forming apparatus as claimed in claim 3, wherein the control unit controls the first to fourth developers in a successive circular order of a standby mode, a color image mode, and a mono image mode.

5. The image forming apparatus as claimed in claim 2, wherein the nip separation unit comprises:

a guide plate installed in the main body of the image forming apparatus;

a first sliding member slidably installed on the guide plate to swing the fourth developer;

a second sliding member slidably installed with respect to the guide plate and the first sliding member to swing the first, second, and third developers; and a separation cam installed between the first and second sliding members to move the first and second sliding members.

6. The image forming apparatus as claimed in claim 5, wherein the separation cam comprises:

a first cam unit pushing the first and second sliding member in one direction;

a second cam unit pushing only the second sliding member in the one direction; and a third cam unit that does not push the first and second sliding members.

7. The image forming apparatus as claimed in claim 5, wherein a first cam groove to accommodate the separation cam is formed on a surface of the first sliding member that is opposite to the second sliding member, a second cam groove to accommodate the separation cam is formed on a surface of the second sliding member that is opposite to the first sliding member, and the separation cam is installed in a cam space formed by the first and second cam grooves.

8. The image forming apparatus as claimed in claim 7, wherein a first cam contact unit that comes in contact with the separation cam is formed in the first cam groove of the first sliding member, and a second cam contact unit that comes in contact with the separation cam is formed in the second cam groove of the second sliding member.

9. The image forming apparatus as claimed in claim 5, wherein the first sliding member comprises:

a first sliding body slidably installed on the guide plate; and a first projection member fixed to the first sliding body and having a pressing projection formed thereon to swing the fourth developer.

10. The image forming apparatus as claimed in claim 9, wherein the second sliding member comprises:

a second sliding body slidably installed with respect to the guide plate and the first sliding member; and a second projection member fixed to the second sliding body and having pressing projections formed thereon to swing the first to third developers.

11. The image forming apparatus as claimed in claim 1, wherein the control unit controls the nip separation unit, so that the respective, developing rollers of first to fourth developers come in contact with the corresponding image carriers in a color image mode.

12. The image forming apparatus as claimed in claim 1, wherein a pressed projection that comes in contact with the nip separation unit is formed at a lower end of the developing unit.

13. The image forming apparatus as claimed in claim 1, wherein a rotating shaft of the developing roller is apart from a center shaft of the developing coupler.

14. The image forming apparatus as claimed in claim 1, wherein the control unit controls the nip separation unit so that the developing roller becomes apart from the image carrier in a state where the developing roller and the image carrier are rotated.

15. A method of controlling an image forming apparatus including at least one developer including an image carrier unit having an image carrier, and a developing unit having a developing roller and installed to swing with respect to the image carrier unit around a developing coupler receiving a driving power from a developing driving coupler installed in a main body of the image forming apparatus, wherein the image carrier and the developer roller can come in contact with or can be separated from each other, and the developing roller is separated from the image carrier in a preparatory mode, the method comprising:

receiving a print command;

rotating the image carrier and the developing roller;

making the developing roller in contact with the image carrier after the image carrier is rotated as much as an angle between the developing roller and a charged body;

separating the developing roller from the image carrier if developing of an electrostatic latent image formed on the image carrier is completed; and stopping the rotation of the developing roller and the image carrier.

16. The method of controlling an image forming apparatus as claimed in claim 15, wherein the at least one developer comprises a yellow image developer, a magenta image developer, a cyan image developer, and a black image developer, and respective developing rollers of the yellow image developer, the magenta image developer, the cyan image developer, and the black image developer come in contact with the image carrier in a color image mode.

17. The method of controlling an image forming apparatus as claimed in claim 16, wherein the respective developing rollers of the yellow image developer, the magenta image developer, and the cyan image developer are separated from the image carrier, and the developing roller of the black image developer comes in contact with the image carrier in a mono image mode.

* * * * *

UNITED STATES PATENT AND TRADEMARK OFFICE

CERTIFICATE OF CORRECTION

PATENT NO. : 8,983,340 B2
APPLICATION NO. : 13/137308
DATED : March 17, 2015
INVENTOR(S) : Jae Hyun Shin et al.

It is certified that error appears in the above-identified patent and that said Letters Patent is hereby corrected as shown below:

In the Claims

Claim 11, column 15, line 48, delete “respective,” and insert --respective--, therefor.

Signed and Sealed this
Twenty-third Day of June, 2015

Michelle K. Lee

Michelle K. Lee
*Director of the United States Patent and Trademark Office*